US008511844B2

(12) United States Patent
Lee

(10) Patent No.: US 8,511,844 B2
(45) Date of Patent: Aug. 20, 2013

(54) REFRIGERATOR

(75) Inventor: Bong-Kook Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1067 days.

(21) Appl. No.: 12/264,767

(22) Filed: Nov. 4, 2008

(65) Prior Publication Data

US 2009/0113916 A1 May 7, 2009

(30) Foreign Application Priority Data

Nov. 5, 2007 (KR) ..... 10-2007-0111976

(51) Int. Cl.
*F21V 33/00* (2006.01)

(52) U.S. Cl.
USPC ..... 362/92; 362/249.02

(58) Field of Classification Search
USPC ..... 362/92, 227, 249.02, 249.12, 284, 362/295; 62/126, 129
See application file for complete search history.

(56) References Cited

U.S. PATENT DOCUMENTS

| | | | | |
|---|---|---|---|---|
| 5,909,950 | A * | 6/1999 | Seok et al. | 362/94 |
| 6,813,896 | B1 * | 11/2004 | Janke et al. | 62/126 |

FOREIGN PATENT DOCUMENTS

| | | | |
|---|---|---|---|
| CN | 1448679 | A | 10/2003 |
| JP | 11-045788 | A | 2/1999 |
| JP | 2001-210480 | A | 8/2001 |
| JP | 2003-302140 | A | 10/2003 |
| KR | 10-1995-0003769 | A | 2/1995 |
| KR | 10-1998-0030434 | A | 7/1998 |
| KR | 20-0139254 | Y1 | 5/1999 |
| KR | 10-2007-0077943 | A | 7/2007 |

* cited by examiner

*Primary Examiner* — Hargobind S Sawhney
(74) *Attorney, Agent, or Firm* — Birch, Stewart, Kolasch & Birch, LLP

(57) ABSTRACT

The embodiment relates to a refrigerator. The refrigerator includes a light emitting unit that lights a storage room; a power supply unit that supplies power for operating the light emitting unit; a door opening sensor including a switch that senses an opening of a door and a first transistor whose base receives an on/off signals of the switch; and a driving unit that drives the light emitting unit according to current output from the door opening sensor.

2 Claims, 2 Drawing Sheets

REFRIGERATOR

BACKGROUND OF THE INVENTION

1. Technical Field

The embodiment relates to a refrigerator.

2. Related Art

Generally, a refrigerator is a device that stores foods at a low-temperature state.

The refrigerator includes a main body that has a storage room storing foods and a door that is rotatably coupled to the main body to open and close the storage room.

The storage room may be provided with a light emitting unit that can allow a user to easily confirm foods stored inside thereof.

The light emitting unit is turned-on when the opening of the door is sensed to emit light. The light emitting unit may be a light emitting diode as one example. In order to increase the brightness of the storage room, the storage room may be provided with a plurality of light emitting diodes.

The on/off of the light emitting unit may be controlled by, for example, a door opening switch that senses the opening of the door. The door opening switch is directly connected to the light emitting unit, such that the light emitting unit may be operated by the turn-on state of the door opening switch.

However, with the above-mentioned structure, as the number of the light emitting unit configuring the light emitting unit is increased, current is increased, such that there may be a problem in a contact of the door opening switching units that switches DC load current.

Also, when the door opening switch switches DC voltage having polarity in the state where current is large, there may be another problem in durability of a contact due to a plating transition phenomenon (a plating of a contact move from + to −) of a contact by an electroplating principle.

SUMMARY OF THE INVENTION

Accordingly, it is an object of the embodiment to provide a refrigerator in which a circuit turning on/off a light emitting unit lighting a storage room can stably be operated.

A refrigerator according to an aspect of the embodiment comprises: a light emitting unit that lights a storage room; a power supply unit that supplies power for operating the light emitting unit; a door opening sensor including a switch that senses an opening of a door and a first transistor whose base receives an on/off signals of the switch; and a driving unit that drives the light emitting unit according to current output from the door opening sensor.

A refrigerator according to another aspect of the embodiment comprises: a light emitting unit that lights a storage room; a power supply unit that supplies power for operating the light emitting unit; a driving unit that drives the light emitting unit in a door opening state; a door opening sensor including a switch that is electrically connected to the power supply unit and senses the door opening; and a regulator that is connected to the door opening sensor and the driving unit and supplies power from the power supply unit to the light emitting unit in the door opening state.

With the proposed embodiment, in order to turn-on/off the light emitting unit configured of the plurality light emitting diodes, the switch is not directly connected to the light emitting unit and controls a small input current (4 to 6 mA) flowing in the base of the first transistor Q1 that is selectively connected to the power supply unit, making it possible to secure the reliability of the contact of the switch.

DESCRIPTION OF EXEMPLARY EMBODIMENT

Hereinafter, preferred embodiments of the embodiment will be described in detail with reference to the accompanying drawings.

Figure 1:
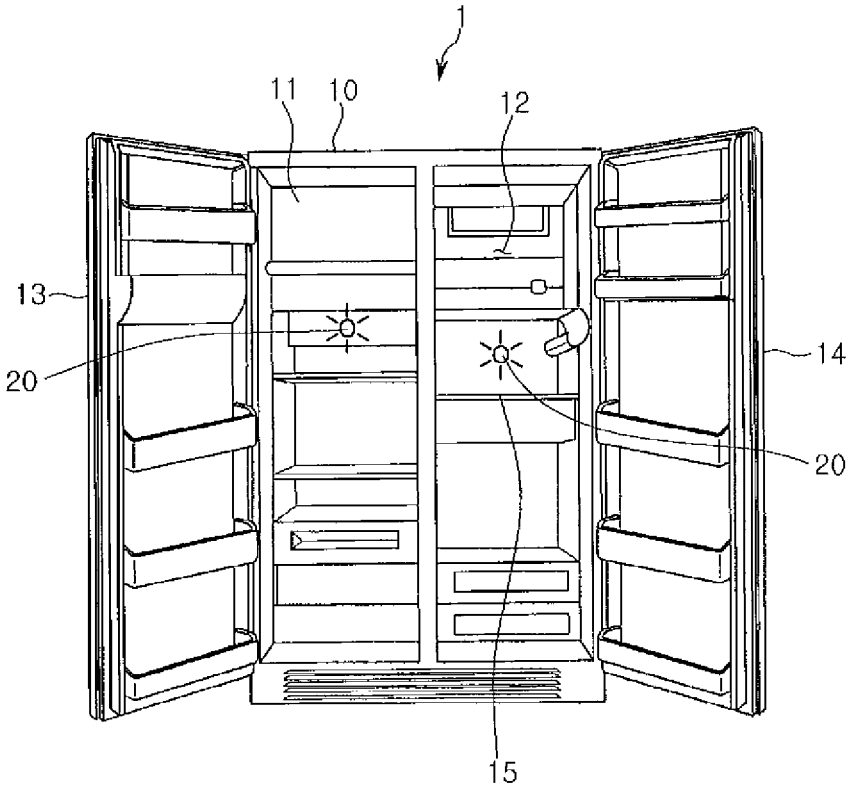
FIG. 1 is a perspective view of a refrigerator in the state where a refrigerator door according to the embodiment is opened.

FIG. 1 is a perspective view of a refrigerator in the state where a refrigerator door according to the embodiment is opened.

Referring to FIG. 1, a refrigerator 1 of the embodiment includes a main body 10 that has a storage room and a door that is rotatably coupled to the main body 10 to open and close the storage room.

The storage room may include a freezing chamber 11 and a refrigerating chamber 12. The door may include a freezing chamber door 13 that opens and closes the freezing chamber 11 and the refrigerating chamber door 11 that opens and closes the refrigerating chamber 12.

In the embodiment, the refrigerator in a type where the freezing chamber 11 and the refrigerating chamber 12 are arranged left and right is described as an example, but a kind of a refrigerator is not limited. Also, the present embodiment can be applied to any one of the freezing chamber and the refrigerating chamber.

The inner parts of each of the freezing chamber 11 and the refrigerating chamber 12 can be partitioned into a plurality of spaces by one or more shelf 15. Each of the freezing chamber and the refrigerating chamber can be provided with a light emitting unit 20 that lights the plurality of spaces or any one of the plurality of spaces.

The light emitting unit 20 may include a plurality of light emitting diodes LED.

Figure 2:
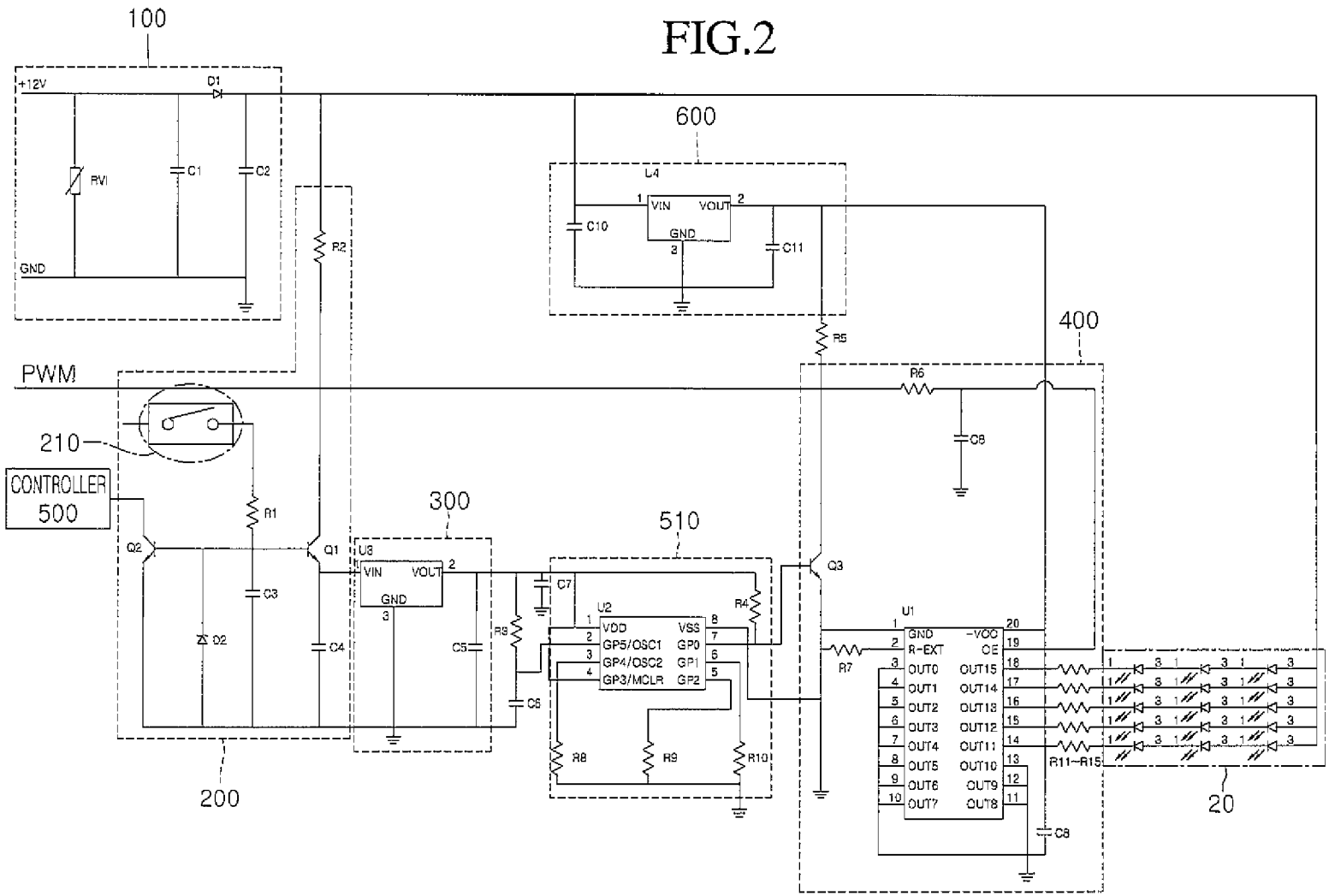
FIG. 2 is a circuit diagram showing a control structure of the refrigeration according to the embodiment.

FIG. 2 is a circuit diagram showing a control structure of the refrigerator according to the embodiment.

Referring to FIG. 2, the refrigerator 1 of the embodiment includes: a power supply unit 100 that supplies power; a door opening sensor 200 that outputs a signal according to the opening of the door; a controller 500 that outputs a control signal according to the sensing results of the door opening sensor 200; a driving unit 400 that drives the light emitting unit 20 according to the current signal output from the door opening sensor 200; a second regulator 600 that constantly supplies the output from the power supply unit 100 to the driving unit 400; a second controller 510 that transmits a signal to the driving unit 400 in the state where the door is opened; and a first regulator 300 that receives power from the power supply unit 100 in the state where the door is opened.

In detail, the power supply unit 100 includes: a chip varistor RV1 that is connected between 12V and a ground; a rectifier diode D1 whose anode is connected to one end of the chip varistor RV1; first and second capacitors C1 and C2 that are connected to the anode and cathode of the rectifier diode D1 and the ground, respectively.

At this time, the chip varistor RV1 is connected 12V and the ground, making it possible to reduce electrostatic discharge (ESD) and noise of the power source applied.

The rectifier diode D1 forms an open loop when the applied voltage is reversely conducted, that is, when a connector is erroneously inserted and the first and second capacitors C1 and C2 performs a role of reducing noise.

The door opening sensor 200 includes a switch 210 that is turned-on/off according to the opening of the doors 13 and 14; a first transistor Q1 whose base receives the turn-on/off signals according to the turn-on/off of the door switch 210, and a second transistor whose base receives the turn-on/off signals according to the turn-on/off signals of the door.

In other words, if the base of the first transistor Q1 is applied with current, a power of 12V is applied to the first regulator 300 that is connected to the collector terminal of the first transistor Q1. Then, an operation signal is transmitted from the second controller 510 to the driving unit, such that the driving unit 400 is operated (switching action) and finally, the light emitting unit 20 can be driven by power supplied from the power supply unit 100.

In the case of the related art, the door switch or the relay are directly connected in order to turn-on/off the light emitting unit. However, when the number of the light emitting diodes configuring the light emitting unit increases, the amount of current increases. When the amount of current is increased, there occurs a problem in the capacitance of the contact of the door switch or the relay.

Therefore, in the embodiment, in order to turn-on/off the light emitting unit 20 configured of the plurality of light emitting diodes, the door switch 210 does not directly control the light emitting unit 20 but controls the small input current (4 to 6 mA) flowing in the base of the first transistor Qt, making it possible to solve the reliability problem of the contacts.

Meanwhile, the driving unit 400 includes: a driver U1 that generates constant current; a resistor R7 that limits the current value allowable by the driver U1; an a plurality of resistors R11 to R16 that divides voltage applied to the light emitting unit 20.

The operation of the refrigerator configured as described above will be described.

The door opening sensor 200 senses whether the door is opened. If the door opening is sensed, the first controller 500 recognizes the turn-on state of the switch 210 through a fact that the second transistor Q2 is turned-on. Then, the first controller 500 judges whether a predetermined time is elapsed from a time point when the door opening is sensed and when the door opening time reaches a predetermined time, operates a signal generator (not shown).

When the switch 210 is turned-on, a signal is applied to the base of the first transistor Q1 and the first transistor Q1 supplies power to the first regulator 500. Then, the driving unit 400 is operated by the second controller 510 to apply power to the light emitting unit 20.

With the embodiment, even when the number (or load) of the light emitting diode configuring the light emitting unit 20 is increased, the contact reliability of the switch 210 can be secured.

What is claimed is:

1. A refrigerator comprising:

a light emitting unit that lights a storage room;

a power supply unit that supplies power for operating the light emitting unit;

a door opening sensor including a switch that senses an opening of a door, a first transistor having a base receiving an on/off signals of the switch and a second transistor having a base receiving the on/off signals of the switch;

a driving unit that drives the light emitting unit according to current output from the door opening sensor;

a first controller connected to the second transistor;

a second controller configured to control the driving unit; and a first regulator electrically connected to the first transistor and the second controller to receive power from the power supply unit, wherein the light emitting unit comprises a plurality of light emitting modules, each light emitting module having a plurality of light emitting diodes, and wherein the plurality of light emitting modules are connected to the driving unit in parallel, and each light emitting module and a resistance are connected to the driving unit in series.

2. The refrigerator according to claim 1, wherein when the switch is opened by the opening of the door, the first transistor is turned-on and the driving unit is operated, such that the light emitting unit is turned-on.

* * * * *